US005295368A

United States Patent [19]

Franklin

[11] Patent Number: 5,295,368

[45] Date of Patent: Mar. 22, 1994

[54] COLD LIQUID AND SLUSH ICE PRODUCER

[76] Inventor: Paul R. Franklin, P.O. Box 37978, Jacksonville, Fla. 32236-7978

[21] Appl. No.: 974,300

[22] Filed: Nov. 10, 1992

[51] Int. Cl.[5] ..... F25D 3/12

[52] U.S. Cl. ..... 62/307; 62/388; 62/434

[58] Field of Search ..... 62/59, 121, 306, 307, 62/384, 388, 430, 434

[56] References Cited

U.S. PATENT DOCUMENTS

| | | | |
|---|---|---|---|
| 1,712,701 | 5/1929 | Hassensall . | |
| 2,893,216 | 7/1959 | Seefeldt et al. | 62/63 |
| 3,400,551 | 9/1968 | Booth et al. | 62/135 |
| 4,094,164 | 6/1978 | Cope | 62/74 |
| 4,680,119 | 7/1987 | Franklin, Jr. | 210/512.1 |
| 4,838,039 | 6/1989 | Knodel | 62/330 |
| 4,848,095 | 7/1989 | Franklin | 62/121 |
| 5,092,133 | 3/1992 | Franklin | 62/59 |
| 5,154,064 | 10/1992 | Franklin | 62/59 |

*Primary Examiner*—William E. Tapolcai

*Attorney, Agent, or Firm*—Jacobson, Price, Holman & Stern

[57] ABSTRACT

An open top tank is provided in which slush ice may be rapidly formed by a method forcibly projecting the formed slush ice from the tank or by a method retaining the slush ice within the tank for removal therefrom by other means. In addition, the tank may be used to cool liquid therein such as propylene glycol down to −20° F. −30° F. such that food stuffs may be dipped into the chilled propylene glycol for quick freezing of the food. The tank is portable and needs only a supply of liquid $CO_2$ under pressure and propylene glycol (or water if slush ice is to be formed).

8 Claims, 1 Drawing Sheet

COLD LIQUID AND SLUSH ICE PRODUCER

BACKGROUND OF THE INVENTION

1. Field of the Invention

This invention relates to an apparatus in which propylene glycol may be chilled through the utilization of liquid $CO_2$ to a temperature considerably below freezing to thereby enable food to be immersed in the propylene glycol for quick freezing of the food. Also, the invention further relates to an apparatus which, by the substitution of water for the propylene glycol therein, may be used to produce slush ice and to forcibly project slush ice from the apparatus directly to a point of use such as the interior of a transport container for food stuffs and the like.

2. Description of the Related Art

Various different forms of devices utilizing some of the neral structural and operational features of the instant invention heretofore have been provided such as those disclosed in U.S. Pat. Nos. 1,712,701, 2,893,216, 3,400,551, 4,094,164, 4,680,119, 4,838,039, 4,848,095, 5,092,133 and 5,154,064.

U.S. Pat. No. 5,154,064 includes the same basic construction as that disclosed hereinafter, but provides a circulation pipe which is disposed to the exterior of the tank and which therefore is subject only to ambient air temperature insofar as heat exchange relation is concerned. In addition, in my previously patented device supply water is discharged directly into the tank.

With the instant invention, a second tank is provided into which supply water is discharged to a predetermined level and a communication pipe also is provided for communicating the interiors of the two tanks below the predetermined level of liquid within the second tank. This construction maintains the surface of the water in the second tank reasonably calm for greater control by the float operational water inlet valve. Further, that portion of the circulation pipe of my previously patented slush ice producer which was disposed exteriorly of the tank thereof is enclosed within the second tank of the instant invention below the predetermined liquid level therein and, accordingly, enjoys considerably greater heat exchange relation with the liquid contained within the second tank. This greater heat exchange relation with the liquid within the second tank (which liquid comprises a heat sink) insures that the circulation pipe and the liquid circulating therethrough will not "freeze up" prematurely.

SUMMARY OF THE INVENTION

The cold liquid and slush ice producer of the instant invention incorporates side by side first and second tanks which may contain propylene glycol and in which propylene glycol may be cooled to a temperature considerably below freezing for the purpose of immersing food to be quick frozen within the chilled propylene glycol. Also, the tanks may be utilized to contain water as opposed to propylene glycol and to have water supplied thereto at a considerable volume rate with the water rapidly cooled and transformed into slush ice and thereafter forcibly propelled from a first of the tanks over appreciable distances to thereby enable the apparatus to be used to project slush ice directly into a remote food container or truck body and the like.

The main object of this invention is to provide an apparatus in which food may be quick frozen and which also may be used to produce slush ice at a considerable rate and at minimum cost.

Another object of this invention is to provide an apparatus which may be readily transported from one location to another.

Still another important object of this invention is to provide an apparatus which may be used in the field to produce slush ice for initial packing of farm products in ice immediately after they are picked and as they are placed within a transport container therefore.

Another object of this invention is to provide a slush ice producer which will be capable of producing slush ice, at least intermediately, at a relatively high rate.

Yet another object of this invention is to provide a slush ice producer which may be transported to substantially any location having a supply of water and utilized to produce slush ice substantially immediately upon demand.

A final object of this invention to be specifically enumerated herein is to provide an apparatus in accordance with the preceding objects and which will conform to conventional forms of manufacture, be of simple construction and easy to use so as to provide a device that will be economically feasible, long lasting an relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
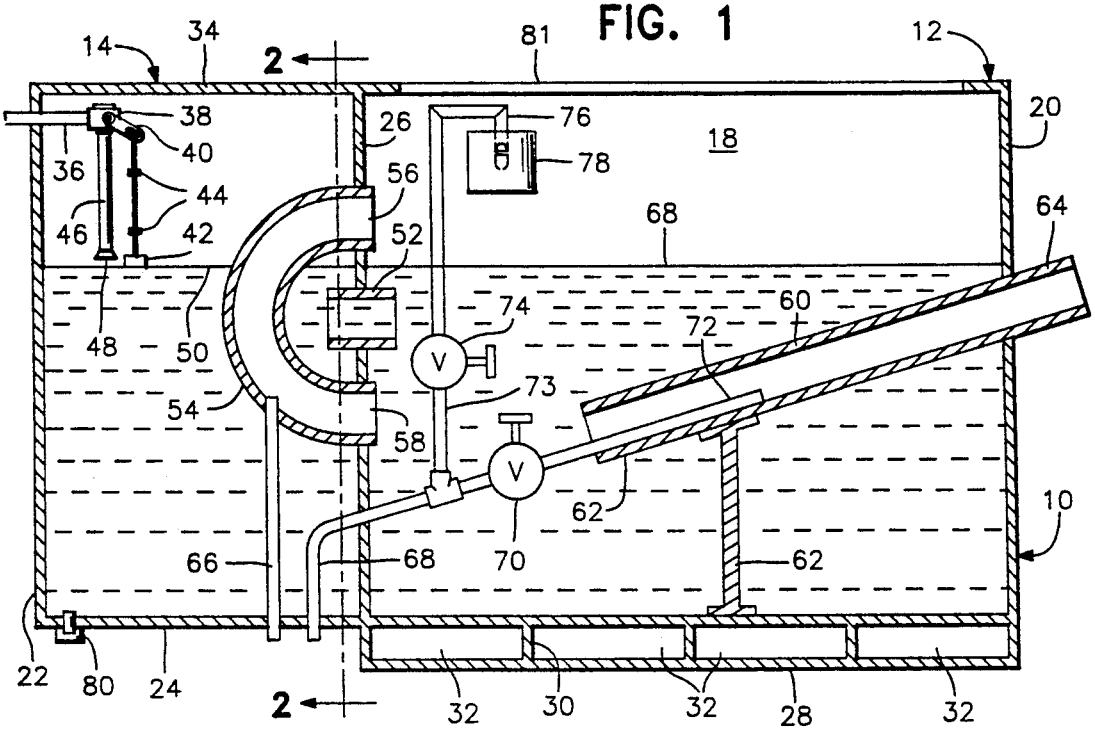
FIG. 1 is a vertical sectional view of a food freezing, cold liquid and ice slush producer constructed in accordance with the present invention.
Figure 2:
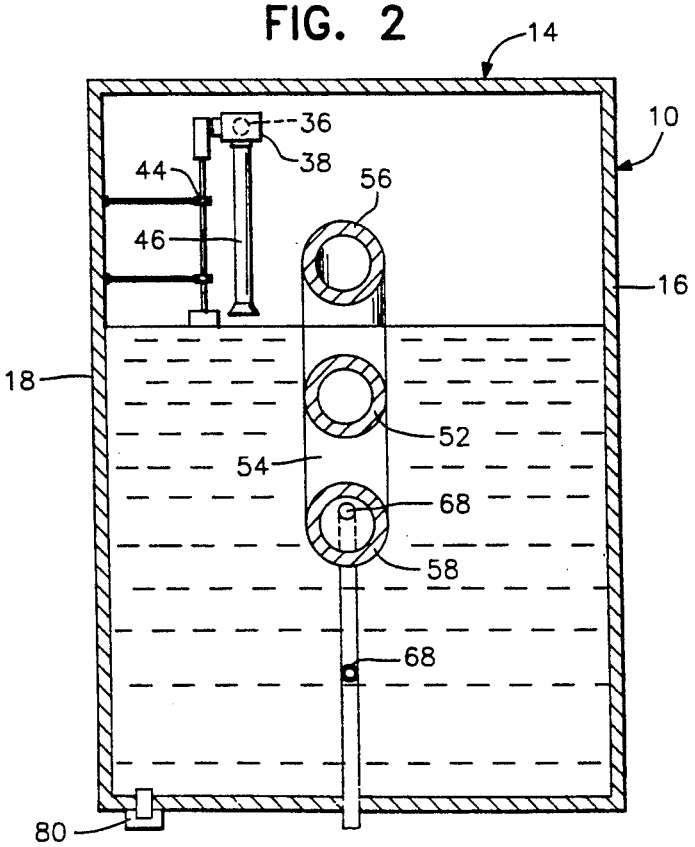
FIG. 2 is a transverse vertical sectional view taken substantially upon the plane indicated by the section line 2—2 of FIG. 1.

Referring now more specifically to the drawings the numeral 10 generally designates the apparatus comprising the cold liquid and slush ice producer of the instant invention. The apparatus 10 incorporates first and second tanks 12 and 14 formed within the confines of a pair of opposite side walls 16 and 18 having pairs of corresponding ends joined by end walls 20 and 22. The lower ends of the walls 16, 18, 20 and 22 are interconnected by a bottom wall 24 extending therebetween and an upstanding transverse partition extends between the side walls 16 and 18 and divides the interior of the apparatus 10 into the tanks 12 and 14. Further, a lower wall is supported beneath the bottom wall 24 through the utilization of partition walls 30 defining a plurality of horizontal compartments 32 immediately beneath that portion of the bottom wall 24 defining the bottom of the tank 12 and in which the forks of a fork lift truck may be received for ease in loading and unloading the apparatus 10 relative to a transport vehicle during transport from one location to another.

The second tank 14 is covered at its upper end by a top wall 34 and the end wall 22 receives a water supply pipe 36 therethrough including a float valve 38 under the control of an operator arm 40 actuated by a float 42 guideingly supported from the side wall 18 by a plurality of vertically spaced guides 44. The float valve 38 includes a depending discharge pipe 46 having an outlet fixture 48 on its lower end. The supply pipe 30, valve 38 and float 42 are operative to admit water into the second tank 14 to a predetermined level 50.

A large diameter communicating pipe 52 opens through the partition 26 and communicates the interiors of the tanks 12 and 14 below the predetermined level 50 and, therefore, the valve 38 and float 42 also are operative to maintain the liquid level within the tank 12 at the predetermined level 50.

A C-shaped circulation pipe 54 is disposed within the second tank 14 and includes upper and lower outlet and inlet ends 56 and 58 opening through the partition 26 and into the interior of the tank 12, a majority of the vertical extent of the circulation pipe 54 being disposed below the predetermined level 50.

Also, a combined educator and discharge pipe 60 is supported within the tank 12 by a brace 62 supported from the bottom wall 24 and the pipe 60 includes a lower inlet end 62 adjacent the partition 26 and an upper outlet end 64 which projects through the end wall 20 in sealed relation therewith at a level generally corresponding to the level 50.

A first liquid $CO_2$ supply line 66 opens upwardly through the bottom wall 24 into the tank 14 and opens upwardly into the interior of the circulation pipe 58 in a manner such that the discharge of liquid $CO_2$ under pressure from the supply line 66 will cause liquid from within the tank 18 to be directed into and to pass through the circulation pipe 54 from the inlet end 58 thereof to the outlet end 56 thereof. In this manner, liquid 68 disposed within the tank 12 is circulated there within and through the circulation pipe 54 while being substantially evenly chilled by the liquid $CO_2$ discharged from the supply line 66 into the circulation pipe 54.

A second liquid $CO_2$ supply line 68 also opens upwardly through the bottom wall 24 and includes an inline valve 70, the discharge end 72 of the supply line 68 terminating within the combined educator and discharge pipe 60. The discharge end 72 opens upwardly along the inclined pipe 60 toward the outlet end 64 thereof such that when liquid $CO_2$ is discharged from the discharge end 72, liquid 68 within the tank 12 will be educted into the pipe 60, move upwardly therethrough and be forcibly discharged from the outlet end 64 thereof, all while having the already chilled water transformed into slush ice in a controlled manner. Also, a branch line 73 opens outwardly of the line 68 upstream from the valve 70 and includes an inline valve 74, the discharge end 76 of the line 72 including a $CO_2$ snow forming nozzle or horn 78 thereon.

The liquid within the tank 14 may be drained therefrom through a suitable removable plug 80 and the tank 12 may be likewise provided with a removable drain plug, if desired. Further, the top wall 34 is abbreviated over the tank 12 in order to provide an upper access opening 81 therein downwardly through which food to be flash frozen may be introduced.

If the apparatus 10 is to be utilized to flash freeze food, the liquid 68 comprises propylene glycol (or a suitable substitute) and the valve 70 is closed while the valve 74 may be opened, if desired. In any event, liquid $CO_2$ is supplied under pressure to the supply line 66 and discharged into the circulation pipe 54. This causes the propylene glycol within the tank 10 to be rapidly circulated through the pipe 54 and within tank 12 and chilled to a temperature of between $-40°$ and $-30°$ F. Thereafter bags of food stuffs may be dipped into the propylene glycol within the tank 12 for fast freezing thereof.

The discharge ends of the supply lines 66 and 68 include single discharge orifices (not shown) approximately ⅛ inch in diameter. Further, if liquid $CO_2$ is discharged from the branch lines 72 through the horn 78, $CO_2$ snow will be downwardly deposited on the upper surface of the liquid 68 and be circulated through the tank 12 beneath the surface to even more quickly chill the liquid 68. However, once the liquid 68 has been chilled for the purpose of fast freezing of food, the discharge of liquid $CO_2$ from the supply line 66 should be sufficient to maintain the liquid 68 at a sufficiently low temperature for fast freezing of bags of food. of course, the exterior of the tank 12 may be insulated if desired and it is to be noted that the circulation pipe 54 will not "freeze up" prematurely and stop the circulation of propylene glycol therethrough, inasmuch as the propylene glycol within the tank 14 comprises a heat sink for the exterior of the circulation pipe 54. Thus, the supply line 66 will not experience excessively elevated internal pressure due to freeze blocking of the circulation pipe 54.

If the apparatus 10 is to be utilized for forming slush ice, the liquid 68 comprises water in both tanks 12 and 14 and liquid $CO_2$ is discharged into the circulation pipe 54 from the supply line 66 and into the pipe 60 from the supply line 68, it not necessarily being required to have liquid $CO_2$ discharged from the line 72 through the horn 78. As the liquid 68 (water) is initially chilled by discharging liquid $CO_2$ from the supply line 66, the water within the tank 14 serves as a heat sink for the circulation pipe 54 and prevents the interior of the latter from freezing solid. Once the temperature of the water within the tank 12 has been sufficiently reduced, liquid $CO_2$ may be discharged from the discharge end 72 of the supply line 68 in a manner to simultaneously educt chilled water f rom the tank 12 into the pipe 60, to further cool the chilled water passing through the pipe 60 to an extent that slush ice is formed and to forcibly eject the formed slush ice from the discharge end 64 of the pipe 60.

As slush ice is discharged from the pipe 60, the volume thereof is replaced by water admitted into the tank 14 through the supply pipe 36 and the level of water within the tank 12 is maintained substantially equal to the level 50 within the tank 14 by the communicating pipe 52. Of course, the constant inlet of water to the tank 14 in order to replenish an equal volume of slush ice discharged from the pipe 60 even further enhances the heat sink properties of the water within the tank 14 in order to ensure that the interior of the pipe 56 will not clog by freezing of water therein. This is very important in order to prevent an excessive buildup of pressure of liquid $CO_2$ within the supply line 66, the rate of flow of liquid $CO_2$ admitted into the supply line 66 being under the control of a flow control valve (not shown).

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalences may be resorted to, falling within the scope of the invention.

What is claimed as new is as follows:

1. A chilled liquid apparatus including tank means defining first and second tank areas therein for containing a liquid, to a predetermined level, to be chilled, communicating means communicating the interiors of said tank areas below said level for the free flow of liquid from said second tank area into said first tank area, circulation conduit means including inlet and outlet ends opening into said first tank area with at least said inlet end disposed beneath said level and an intermediate length portion of said circulation conduit means disposed in said second tank area below said level, and pressurized liquid $CO_2$ discharge means operative to discharge liquid $CO_2$ under pressure into said circulation conduit means in a downstream direction therein to effect liquid circulation from said first tank area, through said circulation conduit, means and back into said first tank area while simultaneously cooling the liquid being circulated, through said circulation conduit means, to prevent freeze up of said circulation conduit means.

2. The apparatus of claim 1 wherein said outlet end opens into said first tank area above said level.

3. The apparatus of claim 1 including means for downwardly discharging $CO_2$ snow on the surface of said liquid in said first tank area.

4. The apparatus of claim 1 including liquid inlet means for admitting liquid into said second tank area to said predetermined level.

5. The apparatus of claim 4 including a slush ice discharge pipe including a lower discharge end disposed in said first tank area and an outlet end opening outwardly of said first tank area and elevated relative to said inlet end at least to said predetermined level, and second pressurized liquid $CO_2$ discharge means operative to discharge liquid $CO_2$ into said discharge pipe in a downstream direction and with sufficient force and volume in relation to the inside diameter of said discharge pipe to propel water and slush ice outwardly of said discharge end of said discharge pipe.

6. An apparatus for producing slush ice, said apparatus including tank means defining first and second tank areas having water inlet means in said second tank area operative to admit water, as needed, into said second tank area to maintain the water therein at least substantially to a predetermined level, communicating means communicating the interiors of said tank areas below said level for the free flow of water from said second tank area into said first tank area, a slush ice projection pipe including an upstream end opening within said first tank area below said level and a downstream end opening outwardly of said first tank area and elevated relative to said upstream end at least to said predetermined level, first pressurized liquid $CO_2$ discharge means operative to discharge pressurized liquid $CO_2$ into said projection pipe in a downstream direction, circulation conduit means including inlet and outlet ends opening into said first tank area with at least said inlet end disposed below said level and an intermediate length portion of said circulation conduit means disposed in said second tank area below said level, and second pressurized liquid $CO_2$ discharge means operative to discharge liquid $CO_2$ into said circulation conduit means in a downstream direction to effect water circulation from said first tank area, into and through said circulation conduit means and back into said first tank area while simultaneously cooling the water being circulated through said circulation conduit means, said first pressurized liquid $CO_2$ discharge means being operative to discharge liquid $CO_2$ into said pipe with sufficient volume and force to propel water and slush ice outwardly from the downstream end of said slush ice projection pipe.

7. The apparatus of claim 6 wherein said outlet opens into said first tank area above said predetermined level.

8. The apparatus of claim 7 including means for downwardly discharging $CO_2$ snow on the surface of said liquid in said first tank area.

* * * * *